US010443351B2

(12) United States Patent
Hartmann et al.

(10) Patent No.: US 10,443,351 B2
(45) Date of Patent: Oct. 15, 2019

(54) BACKFLOW PREVENTION ASSEMBLY FOR DOWNHOLE OPERATIONS

(71) Applicants: Jannik Paul Hartmann, Hannover (DE); Matthias Gatzen, Isernhagen (DE); Thorsten Regener, Wienhausen (DE)

(72) Inventors: Jannik Paul Hartmann, Hannover (DE); Matthias Gatzen, Isernhagen (DE); Thorsten Regener, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 236 days.

(21) Appl. No.: 15/209,887

(22) Filed: Jul. 14, 2016

(65) Prior Publication Data

US 2018/0016869 A1 Jan. 18, 2018

(51) Int. Cl.

| | |
|---|---|
| ***E21B 34/14*** | (2006.01) |
| ***E21B 47/09*** | (2012.01) |
| ***E21B 34/12*** | (2006.01) |
| ***E21B 7/06*** | (2006.01) |
| ***E21B 21/10*** | (2006.01) |

(Continued)

(52) U.S. Cl.

CPC ..... *E21B 34/12* (2013.01); *E21B 7/06* (2013.01); *E21B 21/103* (2013.01); *E21B 33/14* (2013.01); *E21B 34/063* (2013.01); *E21B 47/09* (2013.01); *E21B 2034/005* (2013.01)

(58) Field of Classification Search

CPC ..... E21B 34/12; E21B 2034/005; E21B 47/09

See application file for complete search history.

(56) References Cited

U.S. PATENT DOCUMENTS 4,415,036 A * 11/1983 Carmody ..... E21B 34/101 137/630.14
4,624,315 A * 11/1986 Dickson ..... E21B 34/102 166/323

(Continued)

FOREIGN PATENT DOCUMENTS

EP 1331356 A2 7/2003

OTHER PUBLICATIONS

Garner, et al. "At the Ready: Subsurface Safety Valves", Houston: SLB oilfield review (2002); 13 pages.

(Continued)

*Primary Examiner* — Shane Bomar
(74) *Attorney, Agent, or Firm* — Cantor Colburn LLP

(57) ABSTRACT

Backflow prevention assemblies and methods for downhole systems having outer strings and inner strings include a housing defining a cavity and being part of the outer string, a flow tube disposed between the inner string and the outer string movable axially within the outer string, and a backflow prevention structure having a flapper and a seal seat, the flapper biased toward a closed position and maintained in an open position by the flow tube. The flapper is housed within the cavity when in the open position and the flapper and seal seat form a fluid seal to prevent fluid flow into or through the flow tube when in the closed position. When the flow tube is moved from a first position that maintains the flapper in the open position to a second position, the backflow prevention structure operates to close the flapper and seal the backflow prevention structure.

18 Claims, 12 Drawing Sheets

(51) Int. Cl.

| | |
|---|---|
| ***E21B 33/14*** | (2006.01) |
| ***E21B 34/06*** | (2006.01) |
| *E21B 34/00* | (2006.01) |

(56) References Cited

U.S. PATENT DOCUMENTS

| | | | | |
|---|---|---|---|---|
| 6,253,853 | B1 | 7/2001 | George | |
| 6,328,109 | B1 * | 12/2001 | Pringle | E21B 23/006 166/321 |
| 9,004,195 | B2 | 4/2015 | Regener et al. | |
| 9,784,057 | B2 * | 10/2017 | Lloyd | E21B 21/10 |
| 9,885,219 | B2 * | 2/2018 | Halbert | E21B 31/107 |
| 2002/0050930 | A1 * | 5/2002 | Thomeer | E21B 23/00 340/853.3 |
| 2002/0153139 | A1 * | 10/2002 | Dennistoun | E21B 29/08 166/298 |
| 2006/0162932 | A1 | 7/2006 | McCalvin | |
| 2007/0062687 | A1 * | 3/2007 | Layton | E21B 23/04 166/63 |
| 2008/0236819 | A1 * | 10/2008 | Foster | E21B 33/12 166/255.2 |
| 2009/0230340 | A1 * | 9/2009 | Purkis | E21B 34/12 251/228 |
| 2009/0272539 | A1 * | 11/2009 | Lloyd | E21B 21/10 166/373 |
| 2011/0155381 | A1 * | 6/2011 | Reaux | E21B 34/066 166/334.1 |
| 2014/0054036 | A1 * | 2/2014 | Regener | E21B 33/14 166/285 |
| 2016/0032713 | A1 | 2/2016 | Hallundbaek et al. | |
| 2016/0069156 | A1 | 3/2016 | Hill et al. | |

OTHER PUBLICATIONS

International Search Report and Written Opinion, International Application No: PCT/US2017/041823, dated Oct. 24, 2017, Korean Intellectual Property Office; International Search Report 3 pages, Written Opinion 10 pages.

* cited by examiner

BACKFLOW PREVENTION ASSEMBLY FOR DOWNHOLE OPERATIONS

BACKGROUND

1. Field of the Invention

The present invention generally relates to backflow prevention devices and backflow prevention systems for downhole tools and/or downhole components.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., a gas or fluid) contained in a formation located below the earth's surface. Different types of tools and instruments may be disposed in the boreholes to perform various tasks and measurements.

In more detail, wellbores or boreholes for producing hydrocarbons (such as oil and gas) are drilled using a drill string that includes a tubing made up of, for example, jointed tubulars or continuous coiled tubing that has a drilling assembly, also referred to as the bottom hole assembly (BHA), attached to its bottom end. The BHA typically includes a number of sensors, formation evaluation tools, and directional drilling tools. A drill bit attached to the BHA is rotated with a drilling motor in the BHA and/or by rotating the drill string to drill the wellbore. While drilling, the sensors can determine several attributes about the motion and orientation of the BHA that can used, for example, to determine how the drill string will progress. Further, such information can be used to detect or prevent operation of the drill string in conditions that are less than favorable.

A well, e.g., for production, is generally completed by placing a casing (also referred to herein as a "liner" or "tubular") in the wellbore. The spacing between the liner and the wellbore inside, referred to as the "annulus," is then filled with cement. The liner and the cement may be perforated to allow the hydrocarbons to flow from the reservoirs to the surface via a production string installed inside the liner. Some wells are drilled with drill strings that include an outer string that is made with the liner and an inner string that includes a drill bit (called a "pilot bit"), a bottomhole assembly, and a steering device. The inner string is placed inside the outer string and securely attached therein at a suitable location. The pilot bit, bottomhole assembly, and steering device extend past the liner to drill a deviated well. The pilot bit drills a pilot hole that is enlarged by a reamer bit attached to the bottom end of the liner. The liner is then anchored to the wellbore. The inner string is pulled out of the wellbore and the annulus between the wellbore and the liner is then cemented.

The disclosure herein provides improvements to drill strings and methods for using the same to drill a wellbore and cement the wellbore during a single trip.

SUMMARY

Disclosed herein are systems and methods for backflow prevention in downhole systems that include an outer string and an inner string movable within the outer string. A backflow prevention assembly as provided herein can include a housing defining a cavity, the housing being part of the outer string, a movable flow tube located within the housing and disposed between the inner string and the outer string, the movable flow tube movable axially within the outer string, and a backflow prevention structure having a flapper and a seal seat, the flapper biased toward a closed position and maintained in an open position by the movable flow tube, wherein the flapper is housed within the cavity of the housing when in the open position, and wherein the flapper and seal seat form a fluid seal to prevent fluid flow into or through the movable flow tube. When the movable flow tube is moved from a first position that maintains the flapper in the open position to a second position, the backflow prevention structure operates to close the flapper to the seal seat and seal the backflow prevention structure.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Disclosed are apparatus and methods for backflow prevention assemblies and systems employed in downhole tools. Embodiments provided herein are directed to backflow prevention assemblies and operations thereof that are configured to prevent backflow in a string configuration that includes an inner string and an outer string. The backflow prevention assemblies as provided herein can include flappers or other backflow prevention structures that are operated by movement of a movable flow tube. Further embodiments of backflow prevention assemblies as provided herein can include position markers for position detection, locking mechanisms for preventing movement, decoupling elements, etc. as shown and described herein.

Figure 1:
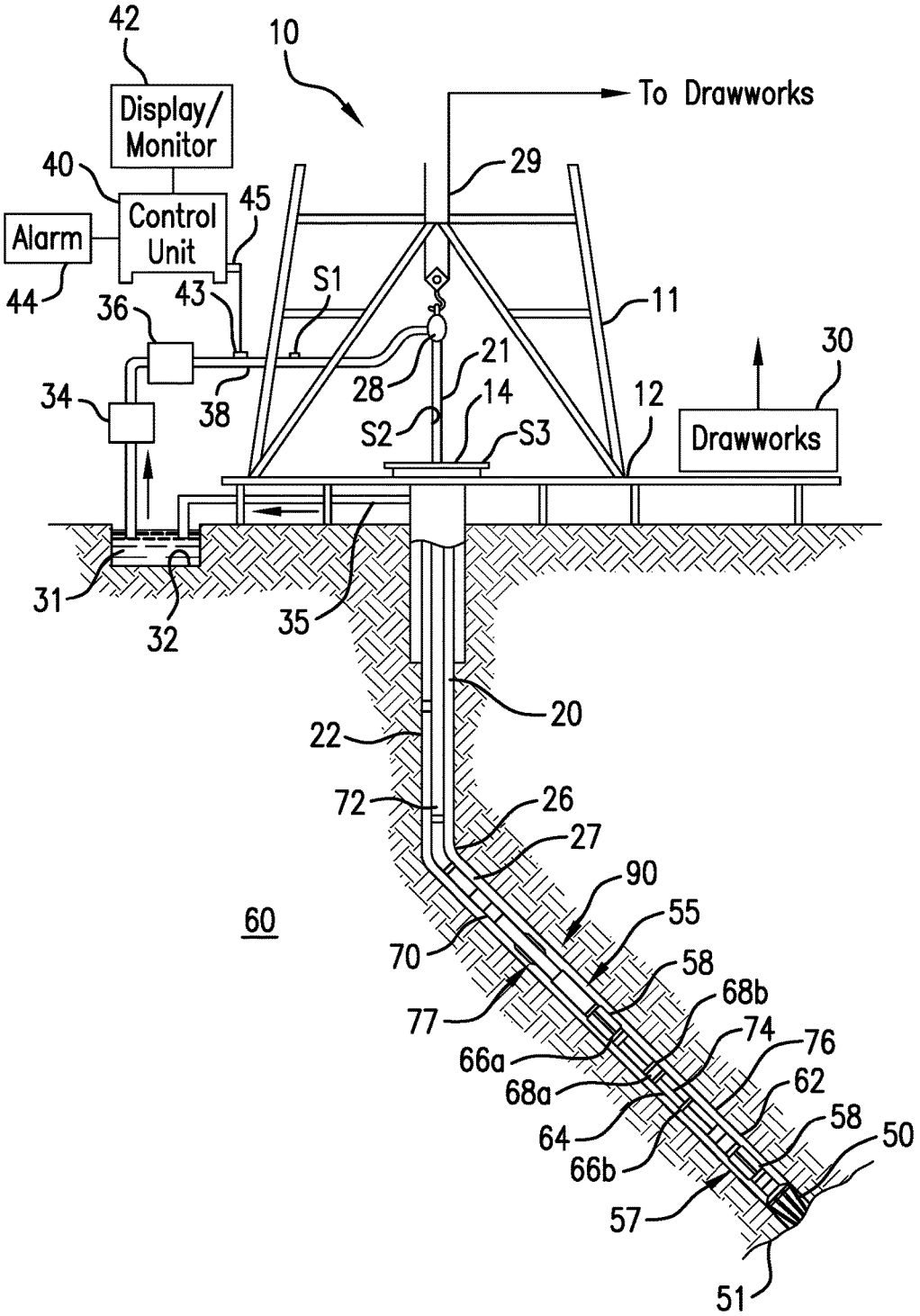
FIG. 1 is an exemplary drilling system.

FIG. 1 shows a schematic diagram of a drilling system 10 that includes a drill string 20 having a drilling assembly 90, also referred to as a bottomhole assembly (BHA), conveyed in a borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the BHA 90, disintegrates the geological formations when it is rotated to drill the borehole 26. The drill string 20 is coupled to a drawworks 30 via a kelly joint 21, swivel 28 and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor S1 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26. The system may further include one or more downhole sensors 70 located on the drill string 20 and/or the BHA 90.

In some applications the disintegrating tool 50 is rotated by only rotating the drill pipe 22. However, in other applications, a drilling motor 55 (mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the borehole 26 for a given formation and a drilling assembly largely depends upon the weight on bit and the drill bit rotational speed. In one aspect of the embodiment of FIG. 1, the mud motor 55 is coupled to the disintegrating tool 50 via a drive shaft (not shown) disposed in a bearing assembly 57. The mud motor 55 rotates the disintegrating tool 50 when the drilling fluid 31 passes through the mud motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and other suitable locations act as centralizers for the lowermost portion of the mud motor assembly and other such suitable locations.

A surface control unit 40 receives signals from the downhole sensors 70 and devices via a sensor 43 placed in the fluid line 38 as well as from sensors S1, S2, S3, hook load sensors and any other sensors used in the system and processes such signals according to programmed instructions provided to the surface control unit 40. The surface control unit 40 displays desired drilling parameters and other information on a display/monitor 42 for use by an operator at the rig site to control the drilling operations. The surface control unit 40 contains a computer, memory for storing data, computer programs, models and algorithms accessible to a processor in the computer, a recorder, such as tape unit, memory unit, etc. for recording data and other peripherals. The surface control unit 40 also may include simulation models for use by the computer to processes data according to programmed instructions. The control unit responds to user commands entered through a suitable device, such as a keyboard. The control unit 40 is adapted to activate alarms 44 when certain unsafe or undesirable operating conditions occur.

The drilling assembly 90 also contains other sensors and devices or tools for providing a variety of measurements relating to the formation surrounding the borehole and for drilling the wellbore 26 along a desired path. Such devices may include a device for measuring the formation resistivity near and/or in front of the drill bit, a gamma ray device for measuring the formation gamma ray intensity and devices for determining the inclination, azimuth and position of the drill string. A formation resistivity tool 64, made according an embodiment described herein may be coupled at any suitable location, including above a lower kick-off subassembly 62, for estimating or determining the resistivity of the formation near or in front of the disintegrating tool 50 or at other suitable locations. An inclinometer 74 and a gamma ray device 76 may be suitably placed for respectively determining the inclination of the BHA and the formation gamma ray intensity. Any suitable inclinometer and gamma ray device may be utilized. In addition, an azimuth device (not shown), such as a magnetometer or a gyroscopic device, may be utilized to determine the drill string azimuth. Such devices are known in the art and therefore are not described in detail herein. In the above-described exemplary configuration, the mud motor 55 transfers power to the disintegrating tool 50 via a hollow shaft that also enables the drilling fluid to pass from the mud motor 55 to the disintegrating tool 50. In an alternative embodiment of the drill string 20, the mud motor 55 may be coupled below the resistivity measuring device 64 or at any other suitable place.

Still referring to FIG. 1, other logging-while-drilling (LWD) devices (generally denoted herein by numeral 77), such as devices for measuring formation porosity, permeability, density, rock properties, fluid properties, etc. may be placed at suitable locations in the drilling assembly 90 for providing information useful for evaluating the subsurface formations along borehole 26. Such devices may include, but are not limited to, acoustic tools, nuclear tools, nuclear magnetic resonance tools and formation testing and sampling tools.

The above-noted devices transmit data to a downhole telemetry system 72, which in turn transmits the received data uphole to the surface control unit 40. The downhole telemetry system 72 also receives signals and data from the surface control unit 40 and transmits such received signals and data to the appropriate downhole devices. In one aspect, a mud pulse telemetry system may be used to communicate data between the downhole sensors 70 and devices and the surface equipment during drilling operations. A transducer 43 placed in the mud supply line 38 detects the mud pulses responsive to the data transmitted by the downhole telemetry 72. Transducer 43 generates electrical signals in response to the mud pressure variations and transmits such signals via a conductor 45 to the surface control unit 40. In other aspects, any other suitable telemetry system may be used for two-way data communication between the surface and the BHA 90, including but not limited to, an acoustic telemetry system, an electro-magnetic telemetry system, a wireless telemetry system that may utilize repeaters in the drill string or the wellbore and a wired pipe. The wired pipe may be made up by joining drill pipe sections, wherein each pipe section includes a data communication link that runs along the pipe. The data connection between the pipe sections may be made by any suitable method, including but not limited to, hard electrical or optical connections, induction, capacitive or resonant coupling methods. In case a coiled-tubing is used as the drill pipe 22, the data communication link may be run along a side of the coiled-tubing.

The drilling system described thus far relates to those drilling systems that utilize a drill pipe to conveying the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the drill bit. Also, when coiled-tubing is utilized, the tubing is not rotated by a rotary table but instead it is injected into the wellbore by a suitable injector while the downhole motor, such as mud motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling can be one configuration or operation used for providing a disintegrating device becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting the liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Figure 2:
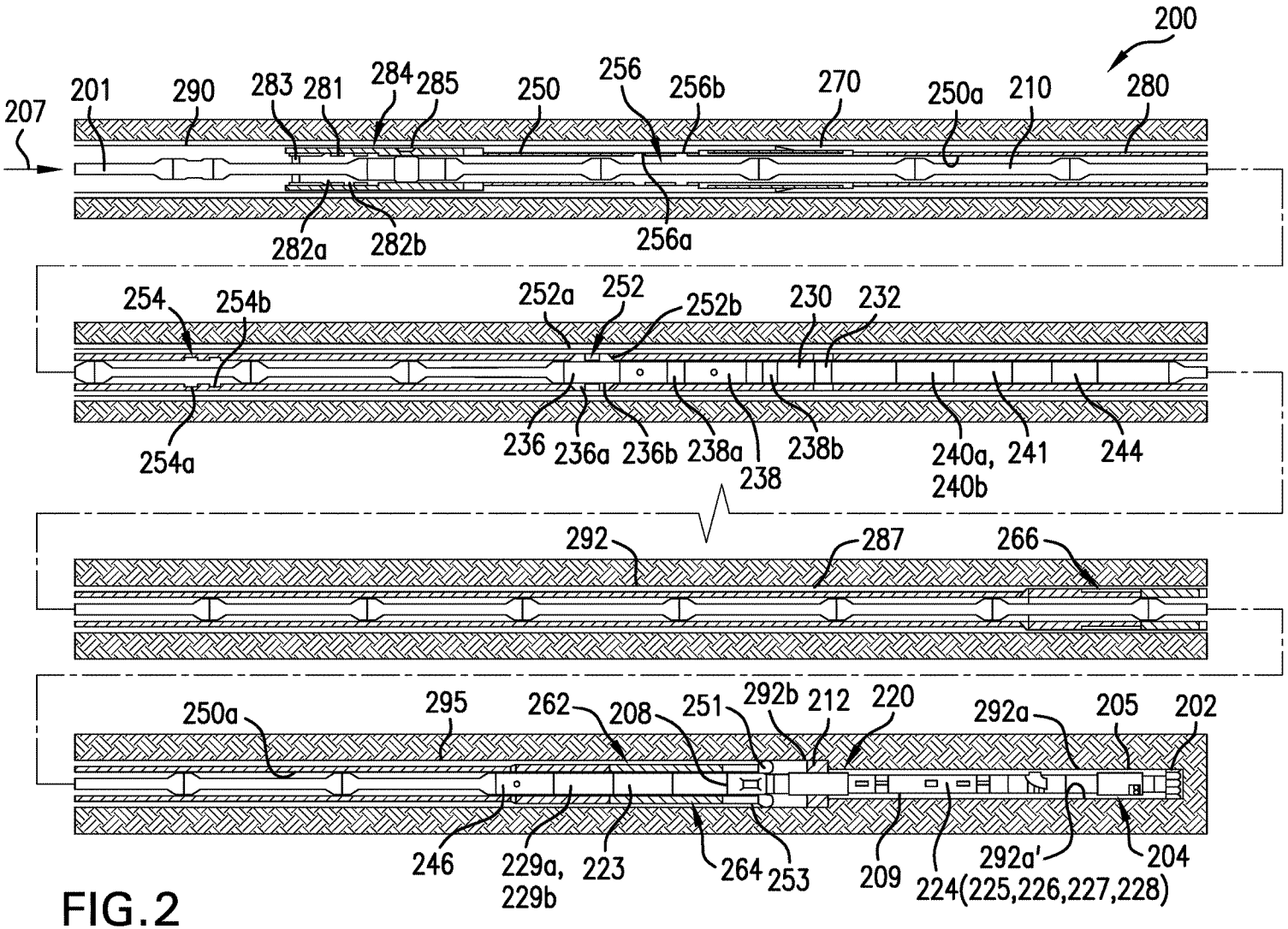
FIG. 2 is a line diagram of an example drill string that includes an inner string and an outer string, wherein the inner string is connected to a first location of the outer string to drill a hole of a first size.

Turning now to FIG. 2, a schematic line diagram of an example string 200 that includes an inner string 210 disposed in an outer string 250 is shown. In this embodiment, the inner string 210 is adapted to pass through the outer string 250 and connect to the inside 250*a* of the outer string 250 at a number of spaced apart locations (also referred to herein as the "landings" or "landing locations"). The shown embodiment of the outer string 250 includes three landings, namely a lower landing 252, a middle landing 254 and an upper landing 256. The inner string 210 includes a drilling assembly or disintegrating assembly 220 (also referred to as the "bottomhole assembly") connected to a bottom end of a tubular member 201, such as a string of jointed pipes or a coiled tubing. The drilling assembly 220 includes a first disintegrating device 202 (also referred to herein as a "pilot bit") at its bottom end for drilling a borehole of a first size 292*a* (also referred to herein as a "pilot hole"). The drilling assembly 220 further includes a steering device 204 that in some embodiments may include a number of force application members 205 configured to extend from the drilling assembly 220 to apply force on a wall 292*a*' of the pilot hole 292*a* drilled by the pilot bit 202 to steer the pilot bit 202 along a selected direction, such as to drill a deviated pilot hole. The drilling assembly 220 may also include a drilling motor 208 (also referred to as a "mud motor") 208 configured to rotate the pilot bit 202 when a fluid 207 under pressure is supplied to the inner string 210.

In the configuration of FIG. 2, the drilling assembly 220 is also shown to include an under reamer 212 that can be extended from and retracted toward a body of the drilling assembly 220, as desired, to enlarge the pilot hole 292*a* to form a wellbore 292*b*, to at least the size of the outer string. In various embodiments, for example as shown, the drilling assembly 220 includes a number of sensors (collectively designated by numeral 209) for providing signals relating to a number of downhole parameters, including, but not limited to, various properties or characteristics of a formation 295 and parameters relating to the operation of the string 200. The drilling assembly 220 also includes a control circuit (also referred to as a "controller") 224 that may include circuits 225 to condition the signals from the various sensors 209, a processor 226, such as a microprocessor, a data storage device 227, such as a solid-state memory, and programs 228 accessible to the processor 226 for executing instructions contained in the programs 228. The controller 224 communicates with a surface controller (not shown) via a suitable telemetry device 229*a* that provides two-way communication between the inner string 210 and the surface controller. The telemetry unit 229*a* may utilize any suitable data communication technique, including, but not limited to, mud pulse telemetry, acoustic telemetry, electromagnetic telemetry, and wired pipe. A power generation unit 229*b* in the inner string 210 provides electrical power to the various components in the inner string 210, including the sensors 209 and other components in the drilling assembly 220. The drilling assembly 220 also may include a second power generation device 223 capable of providing electrical power independent from the presence of the power generated using the drilling fluid 207 (e.g., third power generation device 240*b* described below).

In various embodiments, such as that shown, the inner string 210 may further include a sealing device 230 (also referred to as a "seal sub") that may include a sealing element 232, such as an expandable and retractable packer, configured to provide a fluid seal between the inner string 210 and the outer string 250 when the sealing element 232 is activated to be in an expanded state. Additionally, the inner string 210 may include a liner drive sub 236 that includes attachment elements 236*a*, 236*b* (e.g., latching elements) that may be removably connected to any of the landing locations in the outer string 250. The inner string 210 may further include a hanger activation device or sub 238 having seal members 238*a*, 238*b* configured to activate a rotatable hanger 270 in the outer string 250. The inner string 210 may include a third power generation device 240*b*, such as a turbine-driven device, operated by the fluid 207 flowing through the inner sting 210 configured to generate electric power, and a second two-way telemetry device 240*a* utilizing any suitable communication technique, including, but not limited to, mud pulse, acoustic, electromagnetic and wired pipe telemetry. The inner string 210 may further include a fourth power generation device 241, independent from the presence of a power generation source using drilling fluid 207, such as batteries. The inner string 210 may further include pup joints 244 and a burst sub 246.

Still referring to FIG. 2, the outer string 250 includes a liner 280 that may house or contain a second disintegrating device 251 (e.g., also referred to herein as a reamer bit) at its lower end thereof. The reamer bit 251 is configured to enlarge a leftover portion of hole 292*a* made by the pilot bit 202. In aspects, attaching the inner string at the lower landing 252 enables the inner string 210 to drill the pilot hole 292*a* and the under reamer 212 to enlarge it to the borehole of size 292 that is at least as large as the outer string 250. Attaching the inner string 210 at the middle landing 254 enables the reamer bit 251 to enlarge the section of the hole 292*a* not enlarged by the under reamer 212 (also referred to herein as the "leftover hole" or the "remaining pilot hole"). Attaching the inner string 210 at the upper landing 256, enables cementing an annulus 287 between the liner 280 and the formation 295 without pulling the inner string 210 to the surface, i.e., in a single trip of the string 200 downhole. The lower landing 252 includes a female spline 252*a* and a collet grove 252*b* for attaching to the attachment elements 236*a* and 236*b* of the liner drive sub 236. Similarly, the middle landing 254 includes a female spline 254*a* and a collet groove 254*b* and the upper landing 256 includes a female spline 256*a* and a collet groove 256*b*. Any other suitable attaching and/or latching mechanisms for connecting the inner string 210 to the outer string 250 may be utilized for the purpose of this disclosure.

The outer string 250 may further include a flow control device 262, such as a backflow prevention assembly or device, placed on the inside 250*a* of the outer string 250 proximate to its lower end 253. In FIG. 2, the flow control device 262 is in a deactivated or open position. In such a position, the flow control device 262 allows fluid communication between the wellbore 292 and the inside 250*a* of the outer string 250. In some embodiments, the flow control device 262 can be activated (i.e., closed) when the pilot bit 202 is retrieved inside the outer string 250 to prevent fluid communication from the wellbore 292 to the inside 250*a* of the outer string 250. The flow control device 262 is deactivated (i.e., opened) when the pilot bit 202 is extended outside the outer string 250. In one aspect, the force application members 205 or another suitable device may be configured to activate the flow control device 262.

A reverse flow control device 266, such as a reverse flapper or other backflow prevention structure, also may be provided to prevent fluid communication from the inside of the outer string 250 to locations below the reverse flow control device 266. The outer string 250 also includes a hanger 270 that may be activated by the hanger activation sub 238 to anchor the outer string 250 to the host casing 290. The host casing 290 is deployed in the wellbore 292 prior to drilling the wellbore 292 with the string 200. In one aspect, the outer string 250 includes a sealing device 285 to provide a seal between the outer string 250 and the host casing 290. The outer string 250 further includes a receptacle 284 at its upper end that may include a protection sleeve 281 having a female spline 282*a* and a collet groove 282*b*. A debris barrier 283 may also be provided to prevent cuttings made by the pilot bit 202, the under reamer 212, and/or the reamer bit 251 from entering the space or annulus between the inner string 210 and the outer string 250.

To drill the wellbore 292, the inner string 210 is placed inside the outer string 250 and attached to the outer string 250 at the lower landing 252 by activating the attachment devices 236*a*, 236*b* of the liner drive sub 236 as shown. This liner drive sub 136, when activated, connects the attachment device 236*a* to the female splines 252*a* and the attachment device 236*b* to the collet groove 252*b* in the lower landing 252. In this configuration, the pilot bit 202 and the under reamer 212 extend past the reamer bit 251. In operation, the drilling fluid 207 powers the drilling motor 208 that rotates the pilot bit 202 to cause it to drill the pilot hole 292*a* while the under reamer 212 enlarges the pilot hole 292*a* to the diameter of the wellbore 292. The pilot bit 202 and the under reamer 212 may also be rotated by rotating the drill string 200, in addition to rotating them by the motor 208.

In general, there are three different configurations and/or operations that are carried out with the string 200: drilling, reaming and cementing. In drilling a position the Bottom Hole Assembly (BHA) sticks out completely of the liner for enabling the full measuring and steering capability (e.g., as shown in FIG. 2). In a reaming position, only the first disintegrating device (e.g., pilot bit 202) is outside the liner to reduce the risk of stuck pipe or drill string in case of well collapse and the remainder of the BHA is housed within the outer string 250. In a cementing position the BHA is configured inside the outer string 250 a certain distance from the second disintegrating device (e.g., reamer bit 251) to ensure a proper shoe track.

Various systems, such as shown and described above with respect to FIGS. 1-2, may require cementing to be performed, as known in the art. Embodiments of the present disclosure are directed to liner components that are configured to seal the liner inner diameter against pressure from below to prevent the cement from u-tubing back into the liner. That is, embodiments provided herein are directed to a backflow prevention assembly or system that enables cement to be pumped downhole through the line and out an end thereof, but at the same time can prevent backflow of the cement into the liner. Systems as provided herein can be activated by surface commands. The backflow prevention assembly may employ a backflow prevention structure, such as a flapper, which is biased toward a closed position, and when a fluid pressure applied thereto drops below the biasing force, the backflow prevention structure will close to prevent backflow of cement within the liner, as described herein.

Such backflow prevention systems (e.g., flapper systems and assemblies) may be important component(s) of drilling operation systems that are configured to drill and cement in a single trip (e.g., similar to that shown in FIG. 2). The backflow prevention assembly in accordance with embodiments of the present disclosure is located near the bottom of a liner string (e.g., string 200). The flap of the backflow prevention assembly can be hidden inside a cavity in the housing during drilling operations and can be activated by pulling away a movable flow tube beneath the backflow prevention structure. When activated, the backflow prevention structure works as a non-return valve or structure. Advantageously, such backflow prevention assemblies as provided herein can be employed during cementing operations to prevent the cement from u-tubing back into the liner after cement pumping is completed. Accordingly, in some embodiments, the backflow prevention assembly can be configured to be activated right before a cementing operation (i.e., remotely and/or selectively operable).

Figure 3A:
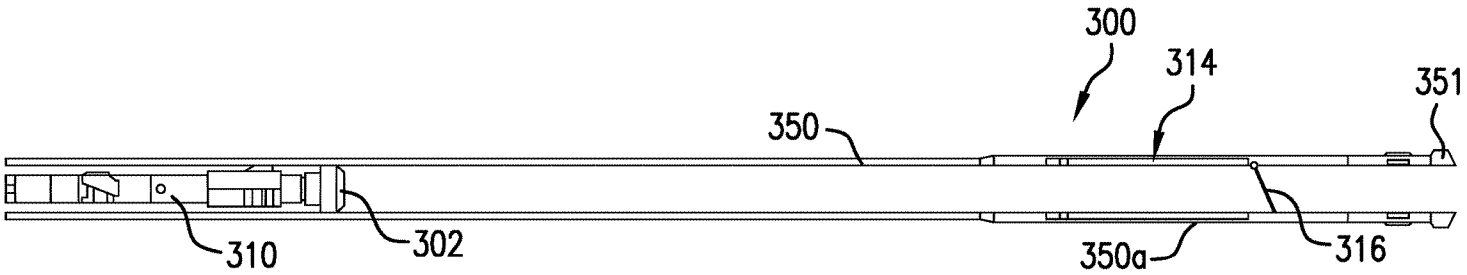
FIG. 3A is a schematic illustration of a string assembly in accordance with an embodiment of the present disclosure.
Figure 3B:
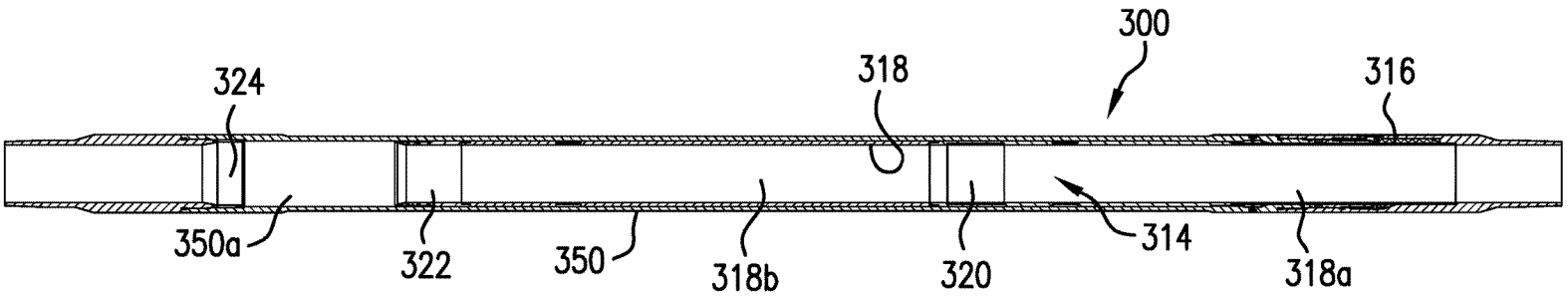
FIG. 3B is an enlarged schematic illustration of a portion of the string assembly of FIG. 3A in a first position.
Figure 3C:
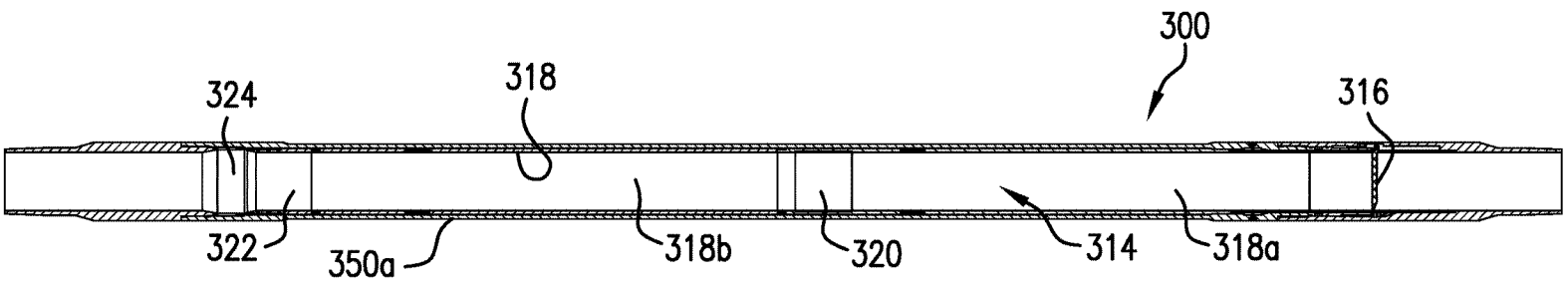
FIG. 3C is an enlarged schematic illustration of a portion of the string assembly of FIG. 3A in a second position.

Turning to FIGS. 3A-3C, various schematic illustrations of a string 300 having a first disintegrating device 302 and a second disintegrating device 351, similar to that shown and described with respect to FIG. 2. The string 300 includes an outer string 350 and an inner string 310. FIG. 3A illustrates a backflow prevention assembly 314 including a backflow prevention structure 316 in a closed position such that fluids (e.g., cement) cannot flow back into the interior of the outer string 350. As shown in FIG. 3A, the inner string 310 is pulled into the interior of the outer string 350. Further, as shown, the backflow prevention assembly 314, in accordance with embodiments of the present disclosure, is operatively attached or connected to the outer string 350. FIG. 3B shows a more detailed illustration of the configuration of the backflow prevention assembly 314 as configured within a housing 350*a* (e.g., a portion of the outer string 350) in a first or open position. FIG. 3C shows a detailed illustration of the configuration shown in FIG. 3B, with the backflow prevention assembly 314 in a second or closed position.

The backflow prevention assembly 314 includes the backflow prevention structure 316, a movable flow tube 318*a*, 318*b* (collectively movable flow tube 318), an engagement element 320, a first position marker 322, and a second position marker 324. The backflow prevention assembly 314 can include other components, for example, as described below, and the present illustrations and accompanying description is not intended to be limiting. The movable flow tube 318, as shown, is composed of a first flow tube portion 318*a* at a first end and a second flow tube portion 318*b* at a second end.

The movable flow tube 318 is configured within the housing 350*a* and is movable therein from the first position to the second position. As shown, the first flow tube portion 318*a* is located proximate the backflow prevention structure 316 and the second flow tube portion 318*b* is located at an opposite end of the movable flow tube 318. The first flow tube portion 318*a*, when in the first position, contains or retains the backflow prevention structure 316 in the open position. For example, in some embodiments, the backflow prevention structure 316 can be housed in a cavity formed between the movable flow tube 318 and the housing 350*a*, and when the movable flow tube 318 is removed, the backflow prevention structure 316 is biased such that the backflow prevention structure 416 will close. In some embodiments, the cavity that houses the backflow prevention assembly 314 may be formed in the structure of the outer string 350 or a housing 350*a*.

The first position marker 322 is attached to and/or movable with the movable flow tube 318, as illustrated between FIGS. 3B-3C. The second position marker 324 is fixed in position within the housing 350*a*. The position markers 322, 324 are used to detect the position of the movable flow tube 318 and the operation (or open/closed position) of the backflow prevention structure 316, as described herein. In some non-limiting embodiments, the position markers 322, 324 can be configured as magnet markers, wherein magnetic fields are detected and/or measured to determine the relative position and/or distance between various magnets in order to determine the position of various components, including but not limited to the movable flow tube 318. In other embodiments, the position markers 322, 324 can be configured as gamma markers, capacitive or conductive elements, tactile and/or mechanical components, etc. that can be used to detect and/or monitor the position of two components that can move relative to each other. Accordingly, those of skill in the art will appreciate that the position markers of the present disclosure are not limited to magnetic markers and magnetic fields, but can be related to any type of marker signal that is based on the type of marker employed.

The engagement element 320, as shown, is located between the first and second portions 318*a*, 318*b* of the movable flow tube 318 (although this position is not to be limiting). The engagement element 320 enables a portion of the inner string 310 to engage with the movable flow tube 318 of the backflow prevention assembly 314 to move the movable flow tube 318 from the first position (FIG. 3B) to the second position (FIG. 3C) and thus allow the backflow prevention structure 316 to close.

Figure 4A:
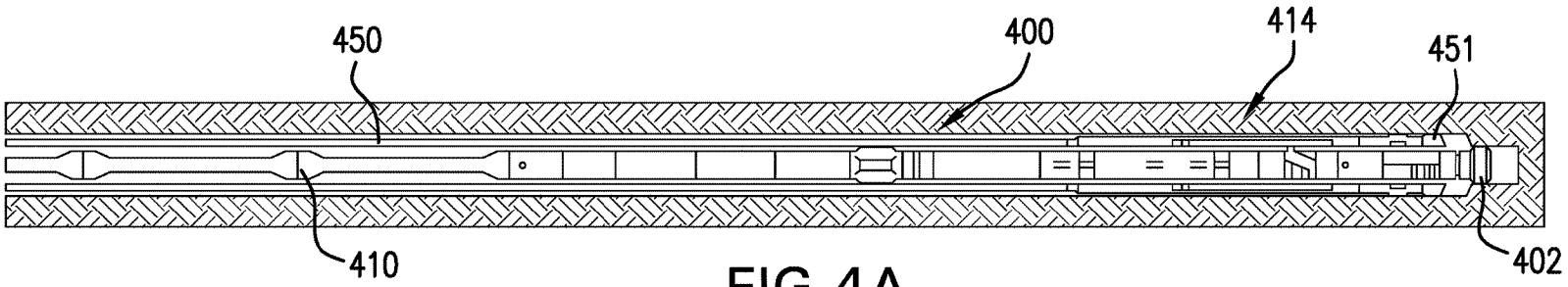
FIG. 4A is schematic illustration of a string and backflow prevention assembly in accordance with an embodiment of the present disclosure, illustrating a drilling operation configuration.
Figure 4B:
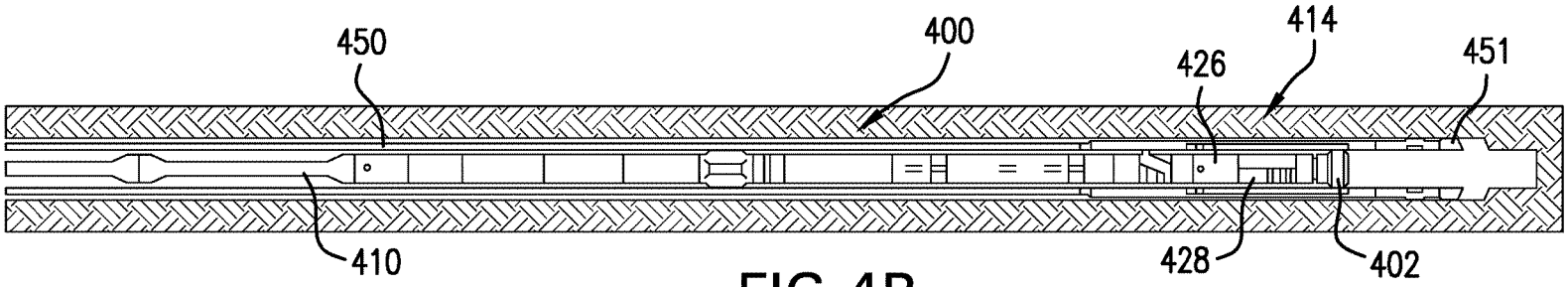
FIG. 4B is a schematic illustration of the string and backflow prevention assembly of FIG. 4A, illustrating an inner string pulled into an outer string in anticipation of a cementing operation.
Figure 4C:
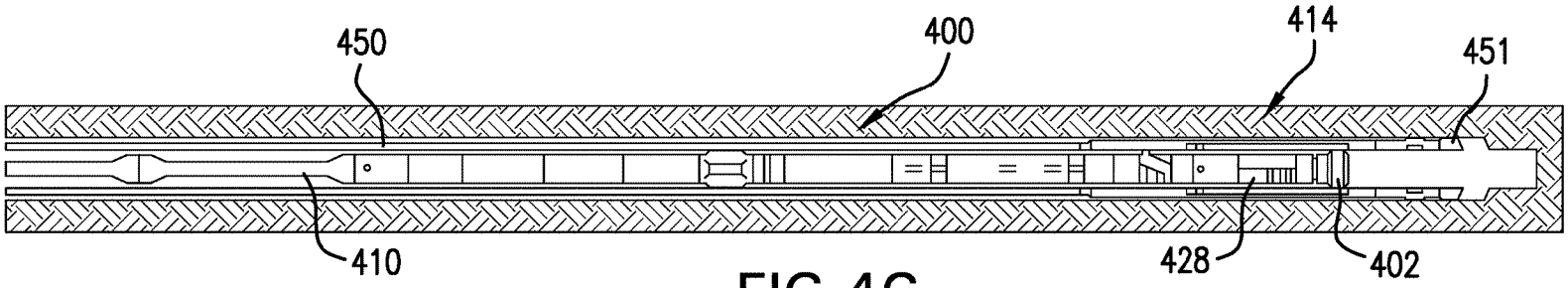
FIG. 4C is a schematic illustration of the string and backflow prevention assembly of FIG. 4A illustrating an engagement of the inner string with a movable flow tube in accordance with an embodiment of the present disclosure.
Figure 4D:
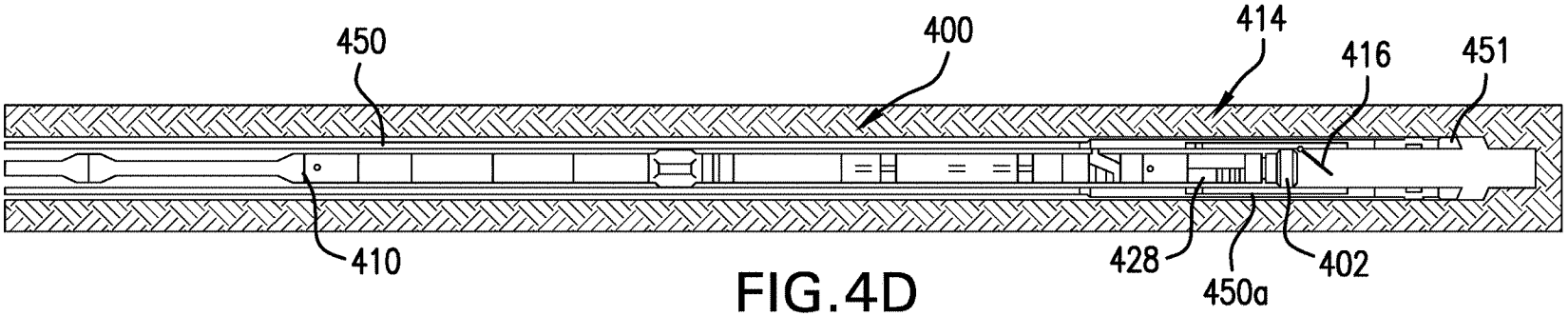
FIG. 4D is a schematic illustration of the string and backflow prevention assembly of FIG. 4A illustrating the closing of a backflow prevention structure in accordance with an embodiment of the present disclosure.
Figure 4E:
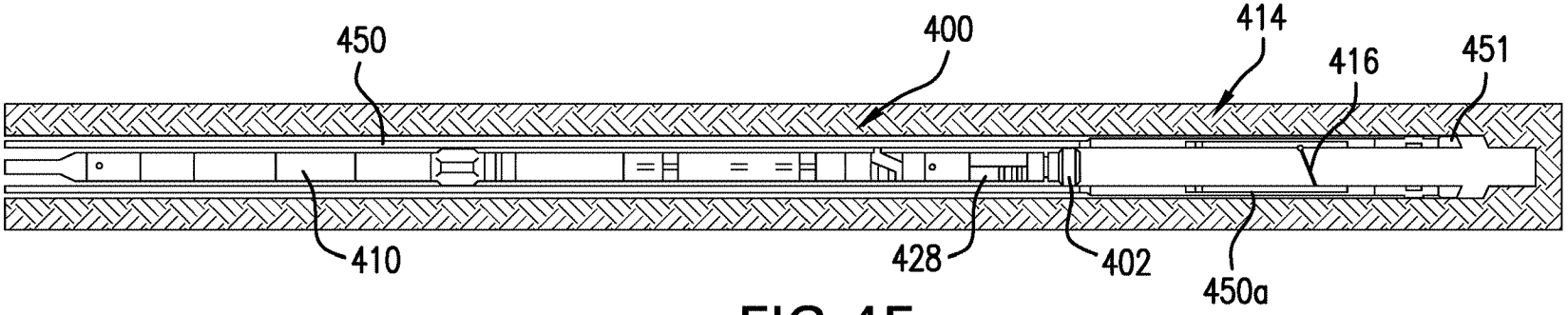
FIG. 4E is a schematic illustration of the string and backflow prevention assembly of FIG. 4A illustrating a closed backflow prevention structure in accordance with an embodiment of the present disclosure.

Turning now to FIGS. 4A-4E, a progression of operating a backflow prevention assembly 414 in accordance with an embodiment of the present disclosure is shown. The backflow prevention assembly 414, similar to that shown and described with respect to FIGS. 3A-3C, is configured within a housing 450*a* (e.g., part of an outer string 450 of a string 400), the outer string 450 having a second disintegrating device 451. An inner string 410 is configured within the outer string 450, the inner string having a first disintegrating device 402 on an end thereof. The backflow prevention assembly 414 is configured such that a portion of the inner string 410 can engage with the backflow prevention assembly 414 to transition the backflow prevention assembly 414 from a first position (FIG. 4A) to a second position (FIG. 4E).

FIG. 4A illustrates the string 400 with the first disintegrating device 402 located close to the second disintegrating device 451, which may be a reaming position. When cementing is desired, the inner string 410 and the first disintegrating device 402 can be pulled into and within the outer string 450. The position of the inner string 410 can be monitored by position markers, as described above. For example, in one non-limiting embodiment, an inner string position marker detector 426 (e.g., a magnetometer) of a steering unit 428 of the inner string 410 can interact with a magnet marker of the outer string (e.g., first magnet marker 322 of the backflow prevention assembly 314 illustrated in FIGS. 3B-3C). Those of skill in the art will appreciate that other position markers and related systems and configurations can be used without departing from the scope of the present disclosure. When a desired position is detected, the inner string 410 can be stopped. The desired position can be an alignment of components of the inner string 410 (e.g., a steering unit 428) and the backflow prevention assembly 414.

With the inner string 410 positioned as desired, a portion of the inner string 410 can be actuated to engage with a portion of the backflow prevention assembly 414, as shown in FIG. 4C. For example, one or more steering elements (e.g., ribs, pads, pistons, or other force application members, as known in the art) of the steering unit 428 can be actuated to engage with the movable flow tube (e.g., movable flow tube 318) of the backflow prevention assembly 414. In some embodiments, the steering ribs can be positioned to engage with an engagement element (e.g., engagement element 320) of the backflow prevention assembly 414.

As shown in FIG. 4D, the inner string 410 and thus the steering unit 428 can be pulled further up-hole. Because of the engage of the inner string 410 with the movable flow tube of the backflow prevention assembly 414, the movable flow tube can be moved up-hole thus exposing the backflow prevention structure 416 of the backflow prevention assembly 414. As shown in FIG. 4D, as the inner string 410 and the movable flow tube of the backflow prevention assembly 414 are moved up-hole, the backflow prevention structure 416 will bias into a closed position.

The backflow prevention assembly 414 is configured with position markers (e.g., position markers 322, 324) that are configured to detect when the movable flow tube is transitioned to the second position, thus indicating that the backflow prevention structure 416 is able to fully close. At this position, as detected by the position markers, the inner string 410 can be disengaged from the backflow prevention assembly 414 (e.g., steering ribs retracted into the steering unit 428) and the inner string 410 can be pulled further up-hole and the backflow prevention structure 416 can be closed to prevent backflow of fluid into the string 400, as shown in FIG. 4E.

In accordance with some embodiments of the present disclosure, a downlinkable tool of the inner string 410 is needed to initiate the activation of the backflow prevention structure 416. This tool (e.g., steering unit 428) is configured to apply axial movement to the movable flow tube (e.g., movable flow tube 318) that is inside the backflow prevention structure 416 at a defined position. The downlinkable tool should be positioned as close to the pilot bit (e.g., first disintegrating device 402) as possible. The steering unit 428 with expandable steering pads or ribs is capable for such operation. The steering pads or ribs enable force to be applied to the movable flow tube inside the backflow prevent assembly in order to clamp it and move it axially (e.g., up-hole) by pulling the drill string (e.g., inner string 410) at the surface (e.g., at a rig).

In one non-limiting example, the exact position for clamping the movable flow tube 318 can be detected with a position marker detector 426 inside the steering unit 428. During drilling operations the position marker detectors 426 of the steering unit 428 are used to determine the orientation of the drill string 400 using earth's magnetic field. The position marker detector 426 is located a specific distance above or from the steering pads inside the steering unit 428. The movable flow tube 318 of the backflow prevention assembly 314, 414 is extended the same length above the clamping position (e.g., engagement element 320). That is, a distance between the engagement element 320 and the first position marker 322 is defined and set as the distance between a position marker detector 426 and steering pads of a steering unit 428. At the top end of the movable flow tube 318 is the second position marker 324. As the first position marker 322 is moved toward the second position marker 324, a marker signal can be measured and thus the position of the movable flow tube 318 can be measured. According, in accordance with some embodiments of the present disclosure, the clamping position (e.g., engagement of inner string 410 to the movable flow tube 318) is achieved when the maximum of the position markers 322, 324 is detected with the position marker detector 426 of the steering unit 428.

The advantage of integrating the first position marker 322 inside the movable flow tube 318 is that the position signal will not get lost when the movable flow tube 318 is being moved (e.g., from the first position to the second position). Advantageously, in accordance with various embodiments of the present disclosure, in case of losing the movable flow tube 318 while pulling it, the exact clamping position can be detected again and the procedure can be repeated.

Figure 5A:
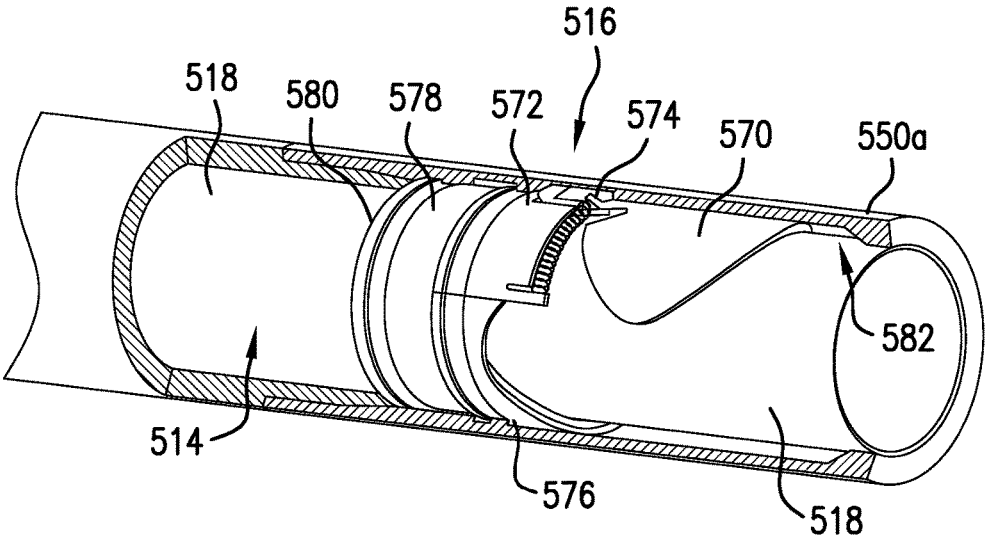
FIG. 5A is a schematic illustration of a backflow prevention assembly in accordance with an embodiment of the present disclosure in a first position.
Figure 5B:
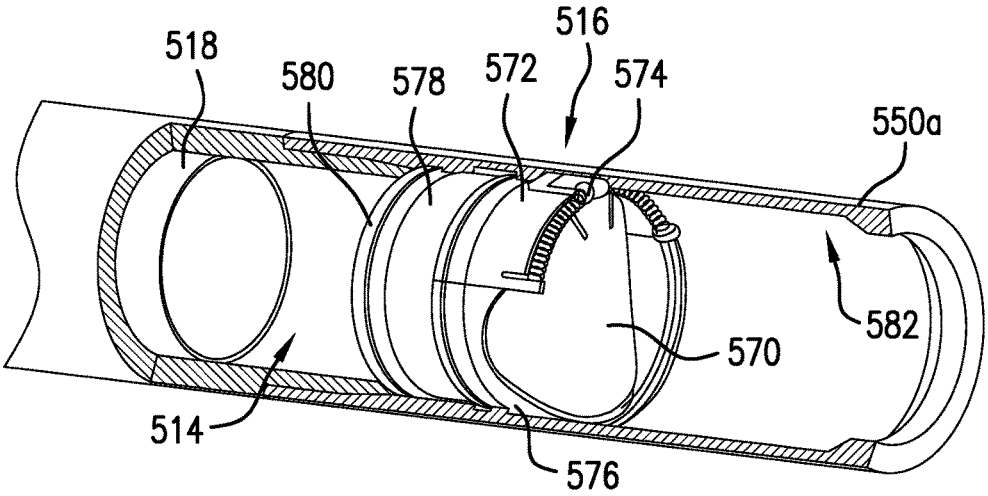
FIG. 5B is a schematic illustration of the backflow prevention assembly of FIG. 5A in a second position.

Turning not to FIGS. 5A-5B, schematic illustrations of a backflow prevention structure 516 of a backflow prevention assembly 514 in accordance with a non-limiting embodiment of the present disclosure are shown. FIG. 5A illustrates the backflow prevention structure 516 in a first, open position, and FIG. 5B illustrates the backflow prevention structure 516 in a second, closed position. The backflow prevention structure 516 and backflow prevention assembly 514 can operate as described above, and may include various features as described herein.

As shown, the backflow prevention structure 516 includes a flapper 570, a support 572, a biasing mechanism 574, a shell 576, a seal sleeve 578, and a shim 580. Also shown is a recess or cavity 582 that that is formed in a housing 550*a* and configured to receive the flapper 570 when the backflow prevention structure 516 is in the first, open position. The flapper 570 is movably attached to the support 572 by the biasing mechanism 574. In some embodiments, the biasing mechanism 574 is formed of a spring-biased hinge with a biasing force configured to bias the flapper 570 toward the second, closed position (FIG. 5B).

The shell 576 and the support 572 form an enclosure for the seal sleeve 578. At least one of the seal sleeve 578 and the shell 576 includes a sealing surface or seal seat to which the flapper 570 engages and fluidly seals when the flapper 570 is in the second, closed position. The shim 580 is an optional element that can be used to secure the other components of the backflow prevention structure 516 into position.

FIG. 5A illustrates the movable flow tube 518 extended through the backflow prevention structure 516 such that the flapper 570 is held open in the first position. In such configuration, the flapper 570 is seated with the cavity 582 and does not interfere with drilling operations, cementing operations, and/or other operations that are performed downhole using the string and/or bottomhole assemblies.

However, as the movable flow tube 518 is pulled up-hole, e.g., in anticipation of a cementing operation, as shown in FIG. 5B, the movable flow tube 518 no longer urges the flapper 570 into the open, first position, and thus (if fluid pressure is sufficiently low to be less than the biasing force of the biasing mechanism 574) flapper 570 can close into the second position. The flapper 570 forms a seal with the seal sleeve 578 and/or the shell 576 and thus cement is prevented from backflowing into the string.

It is noted that the flapper 570 has a particular geometric shape that enables the flapper 570 to be stored within the cavity 582 of the housing 550*a* when open and also provide a seal when closed. Further, to achieve this, the seal sleeve 578 and the shell 576 are formed complementary to the flapper 570 to achieve such sealing and preventing backflow of cement.

Figure 6A:
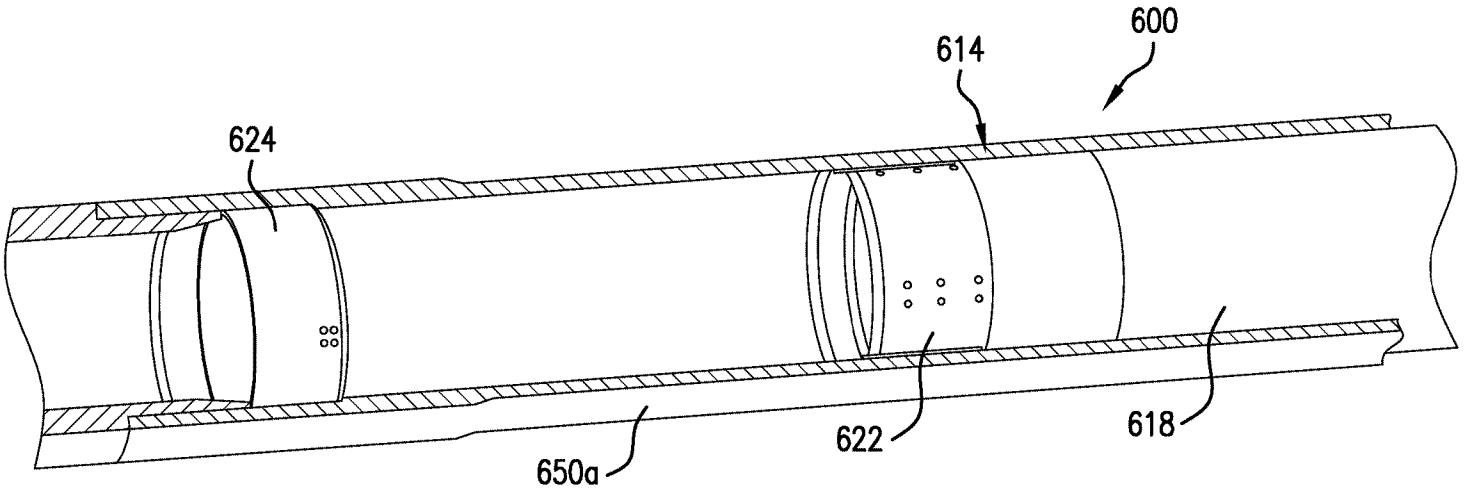
FIG. 6A is a schematic illustration of position markers in accordance with an embodiment of the present disclosure shown in a first position.
Figure 6B:
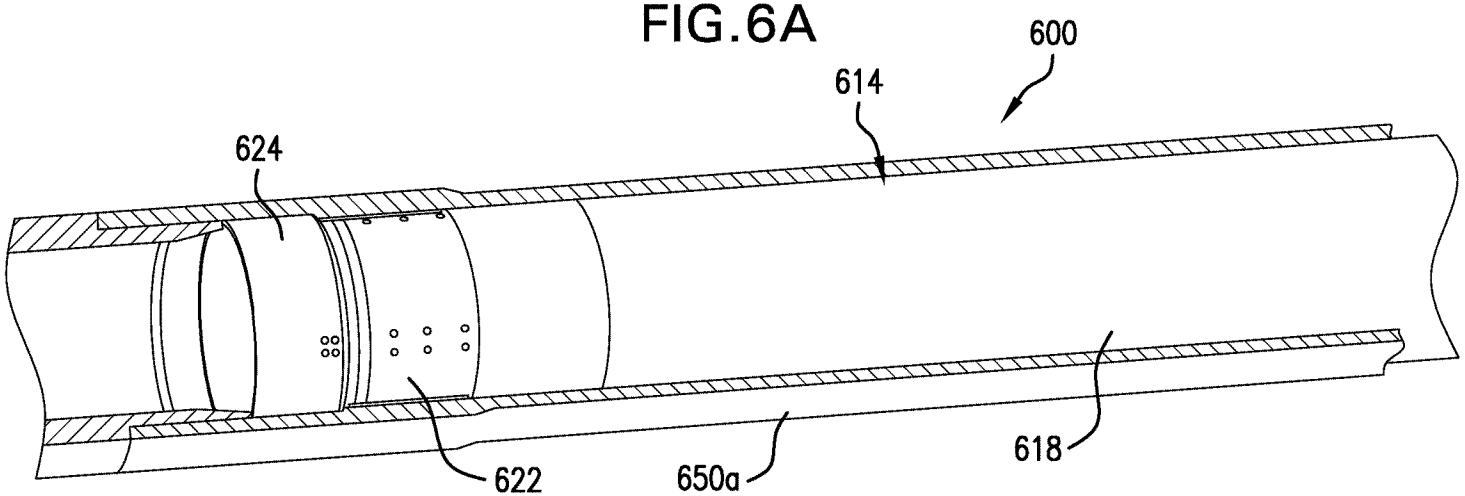
FIG. 6B is a schematic illustration of the position markers of FIG. 6A as shown in a second position.

Further, in accordance with various embodiments of the present disclosure, detection of successful activation of the backflow prevention structure (e.g., the flapper) can be achieved. For example, referring to FIGS. 6A-6B, a sectional illustration of a string 600 having a backflow prevention assembly 614 in a housing 650*a* in accordance with an embodiment of the present disclosure is shown. The backflow prevention assembly 614 is similar to the backflow prevention assemblies described above and includes a movable flow tube 618 with a first position marker 622 attached to or movable by movement of the movable flow tube 618. Further, the backflow prevention assembly 614 includes a second position marker 624 that is fixed to the housing 650*a*. FIG. 6A illustrates the backflow prevention assembly 614 in a first position (i.e., when the backflow prevention structure or flapper is open) and FIG. 6B illustrates the backflow prevention assembly 614 in the second position (i.e., when the backflow prevention structure or flapper is closed).

Because the activation of the backflow prevention assembly is important for the overall system (e.g., knowledge that backflow of cement is prevented), feedback is needed whether the activation procedure was successful or not. Therefore, the second position marker 624 is located at the uppermost travel position of the movable flow tube 618. When the movable first position marker 622 gets close to the fixed second position marker 624, the signal strength is increased. The measurable maximum of the signal strength gets higher than the maximum of one of the single position markers 622, 624. Exceeding a specific value of signal or field strength can be used as indication for successful activation of the backflow prevention structure or flapper.

Figure 7A:
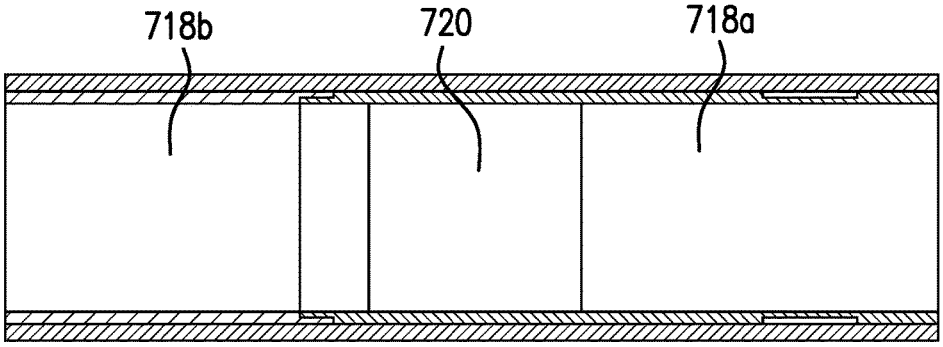
FIG. 7A is a schematic illustration of an engagement element of a backflow prevention assembly in accordance with an embodiment of the present disclosure.
Figure 7B:
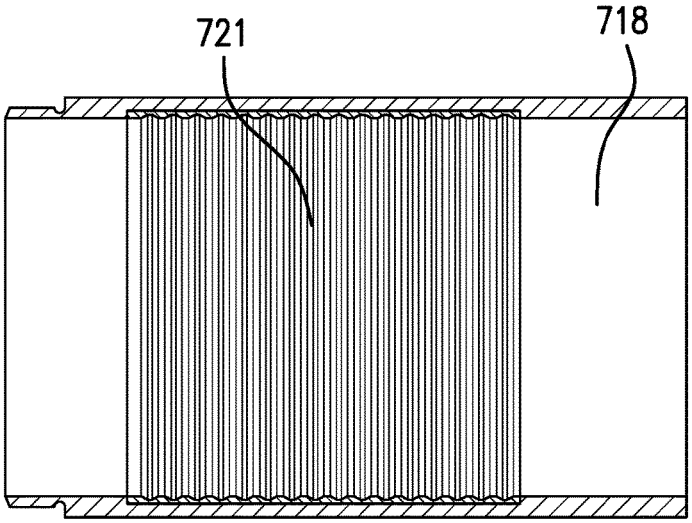
FIG. 7B is a schematic illustration of an engagement element of the present disclosure in accordance with another embodiment.

Turning now to FIGS. 7A-7B, various illustrations of the engagement element of backflow prevention assemblies in accordance with the present disclosure are shown. FIG. 7A illustrates a first configuration of the engagement element 720 in accordance with an embodiment of the present disclosure. FIG. 7B shown an alternative configuration engagement element 721 in accordance with an embodiment of the present disclosure. The engagement elements 720, 721 and variations thereon are components or elements that are configured to enable engagement by a portion of an inner string such that the inner string can apply a force to the backflow prevention assembly to move the movable flow tube and thus operate a backflow prevention structure or flapper. Accordingly, the engagement elements 720, 721 can be formed from various materials that are selected to enable and improve engagement between the inner string and the movable flow tube. For example, in some embodiments, the engagement element can be formed from rubber, metal, composites, etc.

As shown in FIG. 7A, the engagement element 720 is configured within a portion of the movable flow tube 718, and as shown, in an end of a first flow tube portion 718*a*. As shown, the first flow tube portion 718*a* engages with and connects to the second flow tube portion 718*b* to form the movable flow tube 718. In the embodiment of FIG. 7A, the engagement element 720 includes a smooth interior surface that is engageable by a portion of the inner string. In some embodiments, the engagement element 720 can be a rubber coating that is applied to the interior surface of the movable flow tube 718 at a desired location. In other embodiments, the engagement element 720 can be a distinct element that is installed into the movable flow tube 718. In other embodiments, the engagement element 720 can be a treated surface of the movable flow tube 718. For example, as shown in FIG. 7B, the engagement element 721 includes a contouring or texturing that may be selected to improve engagement between the inner string and the movable flow tube 718.

The engagement elements 720, 721 are located at the inner diameter of the movable flow tube 718. In some embodiments, a revolving groove of the movable flow tube 718 can be filled with a rubber material. The engagement elements 720, 721 have two functions. First, the engagement elements of the present disclosure can increase the transmittable axial force when clamping or engaging with steering pads by increasing a friction coefficient. Second, the engagement elements of the present disclosure can hide or minimize the effect of a shoulder or groove, in which the steering pads can latch into when pressed into the engagement element. The engagement element, in accordance with various embodiments of the present disclosure, has the same inner diameter as the movable flow tube. Therefore, there may be no edges where the drill string (e.g., inner string) can get caught when tripping through the backflow prevention assembly. This prevents the backflow prevention structure or flapper of the backflow prevention assembly from accidentally being activated.

Figure 8A:
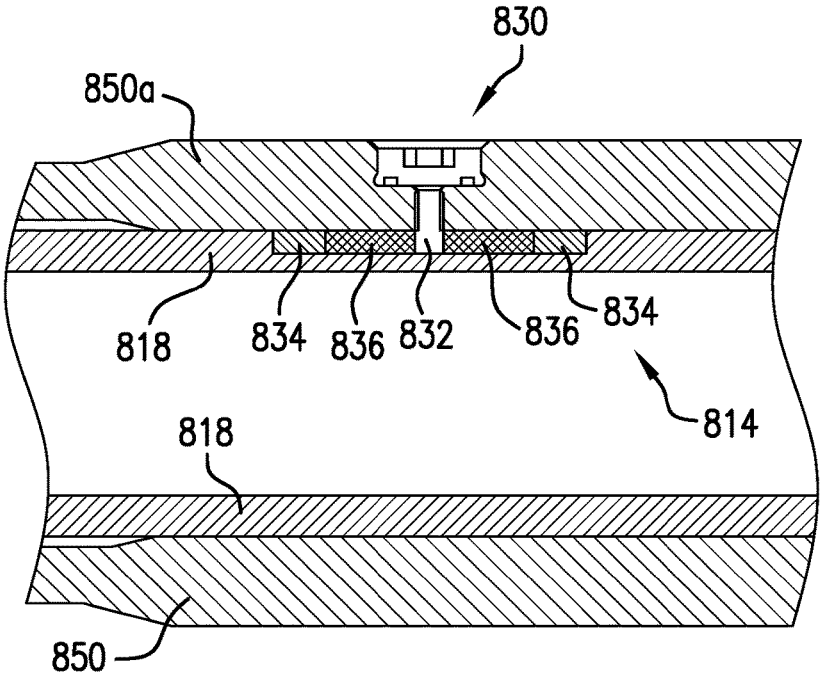
FIG. 8A is a schematic illustration cross-sectional view of a decoupling assembly of a backflow prevention assembly in accordance with an embodiment of the present disclosure.
Figure 8B:
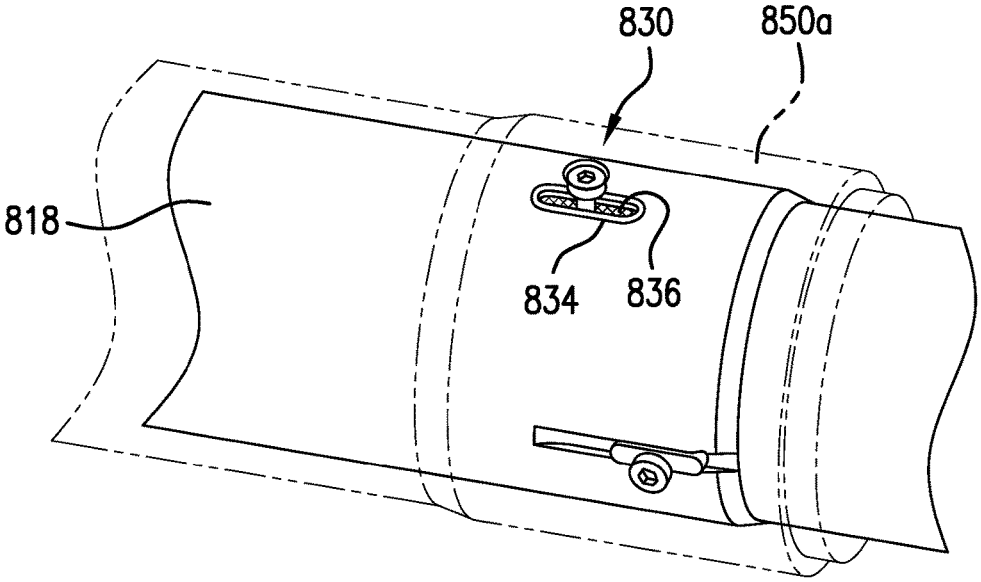
FIG. 8B is an isometric view illustrating the decoupling assembly of FIG. 8A.

Turning now to FIGS. 8A-8B, an optional feature of a backflow prevention assembly in accordance with the present disclosure is shown. FIGS. 8A-8B illustrates a decoupling assembly 830 of a backflow prevention assembly 814. It may be advantageous to protect the backflow prevention assembly (and the backflow prevention structure or flapper) against inadvertent activation. The decoupling assembly 830 includes a shear element 832 that extends through a portion of a housing 850*a* (e.g., a part of an outer string) and through a portion of a movable flow tube 818 of the backflow prevention assembly 814.

Accordingly, as shown in FIGS. 8A-8B, the movable flow tube 818 is held in place by the shear elements 832 (e.g., shear screws, shear pins, etc.) of the decoupling assembly 830. The shear elements 832 prevent relative movement between the housing 850*a* and the movable flow tube 818 below a specific shear force applied to the movable flow tube 818. During drilling operation, the whole assembly has to withstand drilling vibration and high bending loads. Such vibration and loads can cause relative movements between the movable flow tube 818 and the housing 850*a* so that the shear elements could get pre-damaged or accidentally sheared off. To prevent the shear element 832 from being pre-damaged or sheared off, a decoupling element 834 is implemented into a groove at the outer diameter of the movable flow tube 818. The decoupling element 834 surrounds a key 836. The key 836 has a bore in which the shear element 832 can be inserted from the outside.

In accordance with some embodiments, the decoupling element 834 is made out of elastomer and has bores all around to increase elasticity. In some non-limiting embodiments, the decoupling element 834 can compensate relative movement up to approximately 10 mm before the shear element 832 is damaged. Furthermore, in accordance with some embodiments, manufacturing tolerances can be compensated by the decoupling assembly 830.

Figure 9A:
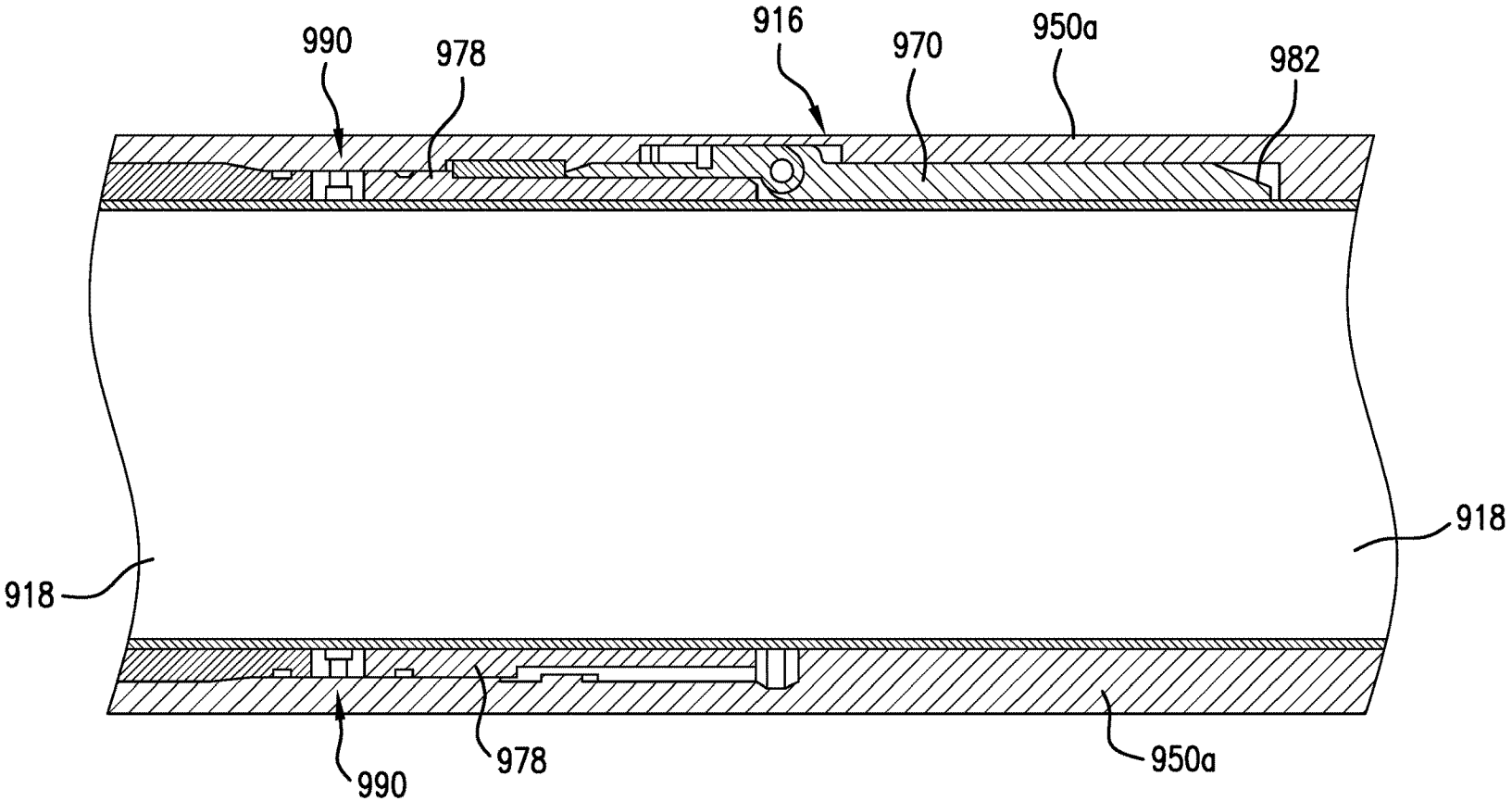
FIG. 9A is a schematic illustration of a locking mechanism in accordance with an embodiment of the present disclosure as installed with a backflow prevention assembly.
Figure 9B:
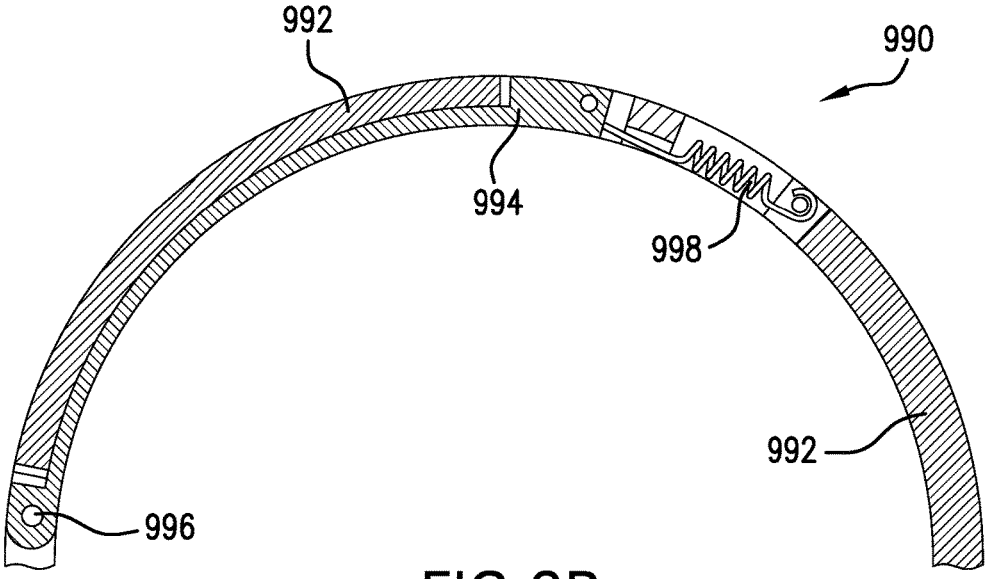
FIG. 9B is a partial schematic illustration of a locking mechanism in accordance with the present disclosure in a first position.
Figure 9C:
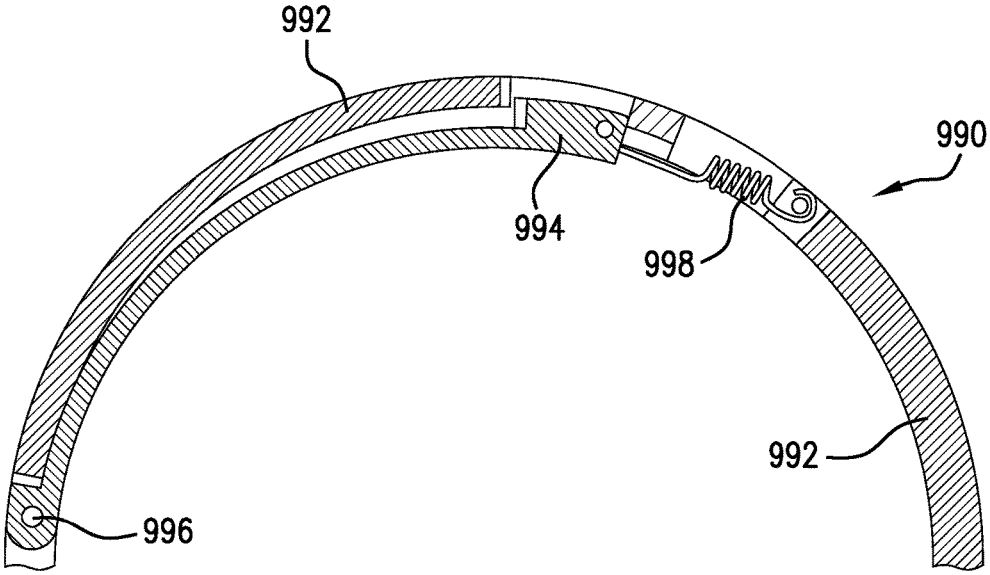
FIG. 9C is an illustration of the partial view of the locking mechanism of FIG. 9B illustrating a second position.

Turning now to FIGS. 9A-9C, another optional feature to be included in backflow prevention assemblies of the present disclosure is shown. FIGS. 9A-9C illustrate a locking mechanism 990 that is configured to lock a movable flow tube 918 in place once the movable flow tube 918 has been pulled back through the backflow prevention structure 916. That is, the function of the locking mechanism 990 is to block the back movement (e.g., downhole movement) of the movable flow tube 918 once the backflow prevention structure 916 has been successfully activated. As shown in FIG. 9A, the locking mechanism 990 is configured adjacent a seal sleeve 978 of the backflow prevention structure 916. In FIG. 9A, a movable flow tube 918 is positioned in the first position and a flap 970 of the backflow prevention structure 916 is stowed in a cavity 982 between the movable flow tube 918 and a housing 950*a*.

The locking mechanism 990 is located as close as possible above the flap 970 in order to keep a required travel distance of the movable flow tube 918 as short as possible during an operation to close the backflow prevention structure 916. Accordingly, as shown in FIG. 9A, the locking mechanism 990 is configured or positioned as a shoulder adjustment ring (i.e., a locking ring) which is located directly behind the seal sleeve 978.

Turning now to FIGS. 9B-9C, illustrations of the operation of the locking mechanism 990 are shown. As shown, the locking mechanism 990 includes a ring 992 housing locking segments 994, which are suspended with a joint 996 at one end and preloaded with a spring 996 at the other end. When the movable flow tube 918 is pulled through the backflow prevention structure 916 and thus past the locking mechanism 990, the locking segments 994 swing inward and generate a mechanical stop for the movable flow tube 918. FIG. 9B illustrates the locking segments 994 in the unlocked position such that the movable flow tube 918 can move relative thereto, and FIG. 9C illustrates the locking segments 994 in the locked position preventing the movable flow tube 918 to move past the locking mechanism 990. In some non-limiting embodiments, the locking mechanism includes two locking segments 994.

Figure 10:
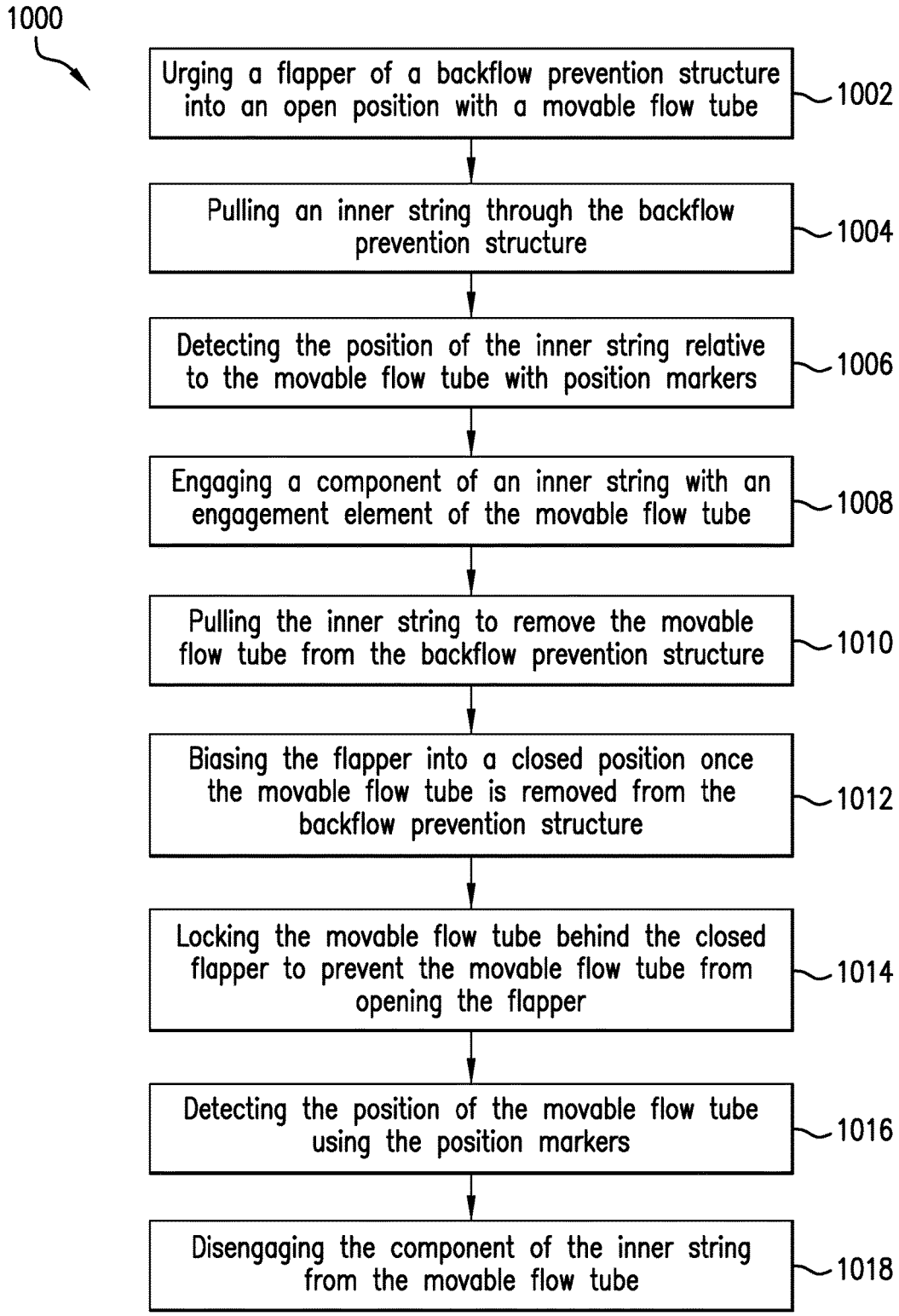
FIG. 10 is a flow process for operating a backflow prevention assembly in accordance with an embodiment of the present disclosure.

Turning now to FIG. 10, a flow process 1000 in accordance with an embodiment of the present disclosure is shown. The flow process 1000 is a process of operating a backflow prevention assembly similar to that shown and described above. Accordingly, the flow process 1000 can be performed using one or more of the string configurations shown and described above or variations thereon. The flow process 1000 can be performed with a downhole string configuration having an inner string housed with and movable within an outer string. The downhole string configuration can be used for performing drilling and completion operations in a one-trip manner, as will be appreciated by those of skill in the art.

At block 1002, a backflow prevention structure of a backflow prevention assembly is urged into an open position by a movable flow tube. The backflow prevention structure (e.g., a flapper) of the backflow prevention assembly can be stored or urged into a cavity of a housing. The housing may be part of the outer string and the inner string can be of smaller diameter than the movable flow tube such that the inner string can move, slide, or translate within the movable flow tube.

When it is desired to perform a cementing operation, the inner string can be pulled up-hole and through the backflow prevention structure, at block 1004. Additionally, the inner string is pulled through the movable flow tube, but does not move the movable flow tube.

At block 1006, the position of the inner string relative to the movable flow tube is detected. Detection of the position of the inner string relative to the movable flow tube can be achieved using position markers. For example, in accordance with one example embodiment, a position marker detector (e.g., a magnetometer) of the inner string can interact with a magnet position marker that is located on the movable flow tube. Those of skill in the art will appreciate that other types of position detection (e.g., gamma markers, capacitive markers, conductive markers, tactile markers, mechanical markers, etc.) can be used without departing from the scope of the present disclosure. Accordingly, the inner string can be positioned as desired relative to the movable flow tube.

At block 1008, with the inner string positioned relative to the movable flow tube, a portion of the inner string (e.g., a component) can be actuated to engage with the movable flow tube. For example, the movable flow tube can include an engagement element that is designed or configured to receive the component or portion of the inner string. In one non-limiting example, a component of a steering unit of the inner string (e.g., a steering pad) can be actuated and extend outward from the inner string and into contact and engagement with the engagement element of the movable flow tube.

At block 1010, with the inner string engaged to the movable flow tube, the inner string can be pulled up-hole and the movable flow tube can be moved in tandem with the inner string. As the movable flow tube moves up-hole, the movable flow tube can be removed from the backflow prevention structure, thus exposing a flapper of the backflow prevention structure.

At block 1012, the flapper can be biased into a closed position because the movable flow tube is no longer urging the flapper into the open position. For example, a spring force can be urging the of the backflow prevention structure into a closed position, and thus when the movable flow tube is removed, the spring force can close the flapper such that the flapper is seated on a seal seat.

At block 1014, a locking mechanism that is up-hole from the backflow prevention structure (or part of the backflow prevention structure or backflow prevention assembly) can engage to lock the movable flow tube in a position above the flapper. The locking mechanism can prevent downhole movement of the movable flow tube and thus prevent the movable flow tube from opening the flapper.

At block 1016, a position of the movable flow tube can be detected using position markers, as described above. The position can be detected such that when the movable flow tube reaches a specific position, it is known that the flapper is uncovered and thus has closed. For example, in one non-limiting example, a first position marker can be attached to or movable with the movable flow tube and a second position marker can be fixed at a specific position up-hole of the first position marker. As the first position marker approaches the second position marker, a detectable and monitored position marker parameter (e.g., magnetic field, radiation, current, etc.) can change based on the position marker configuration, and when the monitored position marker parameter reaches a pre-selected threshold value, it can be known that the first position marker (and thus the movable flow tube) is at a specific location (e.g., a specific distance from the fixed, second position marker).

At block 1018, when the movable flow tube is detected to be located at a specific known position, the inner string can be disengaged from the movable flow tube. Accordingly, the inner string can be moved within the outer string, without moving the movable flow tube therewith.

Advantageously, flow process 1000 enables sealing of a string to prevent cement backflow during and after a cementing process performed downhole. Although the flow process 1000 is presented in a specific order numerically and in a flow order, those of skill in the art will appreciate that the particular processes can be performed in any specific order or certain of the steps can be performed simultaneously or nearly simultaneously. For example, in one non-limiting example, steps 1010-1016 can all be performed simultaneously or nearly simultaneously during a pulling process of the inner string. Accordingly, although flow process 1000 is presented in a specific format, such flow process 1000 is not intended to be limiting.

Advantageously, embodiments provided herein supply a backflow prevention assembly and/or system for downhole tools and operations that enables the prevention of cement backflow during or after a cementing operation. Further, embodiments provided herein enable one-trip operations such that costs associated with forming a borehole and/or product well or other structure may be reduced. Further, advantageously, embodiments provided herein enable monitoring relative movement between a movable flow tube and a drill string inside this movable flow tube by a movable position marker. Moreover, embodiments provided herein enable detection of the uppermost position of a movable flow tube inside a housing via addition of the signal of two different position markers. Furthermore, advantageously, a rubber-coated inner contour can be provided to increase friction when clamping with steering pads and thus improve movability of a movable flow tube to enable activation of a backflow prevention structure or flapper. In some such embodiments, an inner contour of an engagement element can be filled with rubber to provide a form-locking if radial force is applied. Furthermore, advantageously, a decoupling element can protect a shear pin or shear screw from vibration and micro-movement caused by bending loads in a string system. Moreover, a locking mechanism can be provided with swinging segments which block back movement when a movable flow tube is pulled through and past the locking mechanism.

Embodiment 1: A backflow prevention assembly of a downhole system including an outer string and an inner string movable within the outer string, the backflow prevention assembly comprising: a housing defining a cavity, the housing being part of the outer string; a movable flow tube located within the housing and disposed between the inner string and the outer string, the movable flow tube movable axially within the outer string; and a backflow prevention structure having a flapper and a seal seat, the flapper biased toward a closed position and maintained in an open position by the movable flow tube, wherein the flapper is housed within the cavity of the housing when in the open position, and wherein the flapper and seal seat form a fluid seal to prevent fluid flow into or through the movable flow tube when in the closed position, wherein when the movable flow tube is moved from a first position that maintains the flapper in the open position to a second position, the backflow prevention structure operates to close the flapper to the seal seat and seal the backflow prevention structure.

Embodiment 2: The apparatus according to any of the preceding embodiments, wherein the backflow prevention structure further includes a support and biasing mechanism that biases the flapper toward the closed position.

Embodiment 3: The apparatus according to any of the preceding embodiments, wherein the backflow prevention structure further includes a locking mechanism configured to lock after the movable flow tube is moved to the second position, wherein the locking mechanism prevents movement of the movable flow tube toward the first position after locking.

Embodiment 4: The apparatus according to any of the preceding embodiments, wherein the locking mechanism includes one or more locking segments that are suspended with a joint and preloaded with a spring such that after the movable flow tube moves past the one or more locking segments, the spring biases a respective locking segment to pivot about the joint to lock the movable flow tube.

Embodiment 5: The apparatus according to any of the preceding embodiments, wherein the movable flow tube includes one or more engagement elements configured to receive a portion of the inner string, wherein when the portion of the inner string is engaged with the one or more engagement elements movement of the inner string applies force to the movable flow tube and moves the movable flow tube with the movement of the inner string.

Embodiment 6: The apparatus according to any of the preceding embodiments, wherein the one or more engagement elements comprise at least one of a rubber material or a contoured material.

Embodiment 7: The apparatus according to any of the preceding embodiments, further comprising a first position marker attached to the movable flow tube, the first position marker configured to interact with a component of the inner string to monitor a position of the movable flow tube.

Embodiment 8: The apparatus according to any of the preceding embodiments, further comprising a second position marker fixed to the housing and configured to change a monitored position marker parameter when the first position marker is moved in proximity to the second position marker to monitor the position of the movable flow tube.

Embodiment 9: The apparatus according to any of the preceding embodiments, further comprising a decoupling assembly configured to prevent relative movement between the housing and the movable flow tube, wherein the decoupling assembly includes a shear element securing the movable flow tube to the housing below a pre-selected shear force applied to the movable flow tube.

Embodiment 10: The apparatus according to any of the preceding embodiments, wherein the decoupling assembly includes a decoupling element surrounding a key, wherein the key defines an aperture through which the shear element passes through the housing, the decoupling element enabling relative movement of the movable flow tube and the housing below a threshold amount that is based on the pre-selected shear force.

Embodiment 11: The apparatus according to any of the preceding embodiments, wherein the movable flow tube includes: an engagement element configured to receive an actuating portion of the inner string, and a first position marker attached to the movable flow tube, the first position marker configured to interact with a position marker detector of the inner string.

Embodiment 12: The apparatus according to any of the preceding embodiments, wherein a distance between the engagement element and the first position marker is defined as a distance between the position marker detector and the actuating portion of the inner string.

Embodiment 13: A method of operating a backflow prevention assembly of a string including an outer string and an inner string movable within the outer string for downhole operations, the backflow prevention assembly including a movable flow tube and a backflow prevention structure, the method comprising: pulling the inner string up-hole and through the movable flow tube and the backflow prevention structure; engaging a component of the inner string with the movable flow tube; moving the movable flow tube up-hole by pulling the inner string up-hole; and sealing the string with the backflow prevention structure.

Embodiment 14: The method according to any of the preceding embodiments, further comprising detecting the position of the inner string relative the movable flow tube prior to engaging the component of the inner string with the movable flow tube.

Embodiment 15: The method according to any of the preceding embodiments, wherein the detection is performed using a position marker detector on the inner string and a first position marker on the movable flow tube.

Embodiment 16: The method according to any of the preceding embodiments, further comprising detecting the position of the movable flow tube after moving the movable flow tube with the inner string.

Embodiment 17: The method according to any of the preceding embodiments, wherein the detection is performed using a first position marker on the movable flow tube and a second position marker that is located up-hole on the outer string from the movable flow tube.

Embodiment 18: The method according to any of the preceding embodiments, further comprising engaging a locking mechanism after the movable flow tube is pulled up-hole by the inner string, wherein the locking mechanism prevents downhole movement of the movable flow tube.

Embodiment 19: The method according to any of the preceding embodiments, further comprising disengaging the component of the inner string from the movable flow tube after moving the movable flow tube up-hole with the inner string.

Embodiment 20: The method according to any of the preceding embodiments, wherein the component of the inner string is a steering element of a steering unit of the inner string.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A downhole system comprising:

an inner string, the inner string having an end and a first disintegrating device located at the end of the inner string;

an outer string, wherein the inner string is movable within the outer string, the outer string having a second disintegrating device located at an end of the outer string, wherein the first disintegrating device is operable to generate a borehole of a first size within a downhole formation and the second disintegrating device is operable to enlarge the borehole within the downhole formation;

and a backflow prevention assembly comprising:

a housing defining a cavity, the housing being part of the outer string;

a movable flow tube located within the housing and disposed between the inner string and the outer string, the movable flow tube including one or more engagement elements configured to receive a portion of the inner string, wherein the one or more engagement elements comprise a rubber material and the movable flow tube is movable axially within the outer string; and a backflow prevention structure having a flapper and a seal seat, the flapper biased toward a closed position and maintained in an open position by the movable flow tube, wherein the flapper is housed within the cavity of the housing when in the open position, and wherein the flapper and seal seat form a fluid seal to prevent fluid flow into or through the movable flow tube when in the closed position, wherein when the movable flow tube is moved from a first position that maintains the flapper in the open position to a second position, the backflow prevention structure operates to close the flapper to the seal seat and seal the backflow prevention structure, wherein in the second position the first disintegrating device is located up-hole relative to the flapper.

2. The downhole system of claim 1, wherein the backflow prevention structure further includes a support and biasing mechanism that biases the flapper toward the closed position.

3. The downhole system of claim 1, wherein the backflow prevention structure further includes a locking mechanism configured to lock after the movable flow tube is moved to the second position, wherein the locking mechanism prevents movement of the movable flow tube toward the first position after locking.

4. The downhole system of claim 3, wherein the locking mechanism includes one or more locking segments that are suspended with a joint and preloaded with a spring such that after the movable flow tube moves past the one or more locking segments, the spring biases a respective locking segment to pivot about the joint to lock the movable flow tube.

5. The downhole system of claim 1, further comprising a first position marker attached to the movable flow tube, the first position marker configured to interact with a component of the inner string to monitor a position of the movable flow tube.

6. The downhole system of claim 5, further comprising a second position marker fixed to the housing and configured to change a monitored position marker parameter when the first position marker is moved in proximity to the second position marker to monitor the position of the movable flow tube.

7. The downhole system of claim 1, further comprising a decoupling assembly configured to prevent relative movement between the housing and the movable flow tube, wherein the decoupling assembly includes a shear element securing the movable flow tube to the housing below a pre-selected shear force applied to the movable flow tube.

8. The downhole system of claim 7, wherein the decoupling assembly includes a decoupling element surrounding a key, wherein the key defines an aperture through which the shear element passes through the housing, the decoupling element enabling relative movement of the movable flow tube and the housing below a threshold amount that is based on the pre-selected shear force.

9. The downhole system of claim 1, wherein:

at least one of the one ore more engagement elements is configured to receive an actuating portion of the inner string, and a first position marker attached to the movable flow tube, the first position marker configured to interact with a position marker detector of the inner string.

10. The downhole system of claim 9, wherein a distance between the engagement element and the first position marker is defined as a distance between the position marker detector and the actuating portion of the inner string.

11. A method of operating a backflow prevention assembly of a downhole system including an outer string and an inner string movable within the outer string for downhole operations, wherein a first disintegrating device is located on an end of the inner string and a second disintegrating device is located on an end of the outer string, wherein the first disintegrating device is operable to generate a borehole of a first size within a downhole formation and the second disintegrating device is operable to enlarge the borehole within the downhole formation, the backflow prevention assembly including a movable flow tube and a backflow prevention structure, wherein the movable flow tube includes one or more engagement elements configured to receive a portion of the inner string and the one or more engagement elements comprise a rubber material, the method comprising:

pulling the inner string up-hole and through the movable flow tube and the backflow prevention structure, such that the first disintegrating device is located up-hole relative to the backflow prevention structure;

engaging a component of the inner string with the movable flow tube;

moving the movable flow tube up-hole by pulling the inner string up-hole; and sealing the string with the backflow prevention structure.

12. The method of claim 11, further comprising detecting the position of the inner string relative the movable flow tube prior to engaging the component of the inner string with the movable flow tube.

13. The method of claim 12, wherein the detection is performed using a position marker detector on the inner string and a first position marker on the movable flow tube.

14. The method of claim 11, further comprising detecting the position of the movable flow tube after moving the movable flow tube with the inner string.

15. The method of claim 14, wherein the detection is performed using a first position marker on the movable flow tube and a second position marker that is located up-hole on the outer string from the movable flow tube.

16. The method of claim 11, further comprising engaging a locking mechanism after the movable flow tube is pulled up-hole by the inner string, wherein the locking mechanism prevents downhole movement of the movable flow tube.

17. The method of claim 11, further comprising disengaging the component of the inner string from the movable flow tube after moving the movable flow tube up-hole with the inner string.

18. The method of claim 11, wherein the component of the inner string is a steering element of a steering unit of the inner string.

* * * * *